US007420571B2

(12) United States Patent
Lee et al.

(10) Patent No.: US 7,420,571 B2
(45) Date of Patent: Sep. 2, 2008

(54) METHOD FOR PROCESSING A GRAY LEVEL IN A PLASMA DISPLAY PANEL AND APPARATUS USING THE SAME

(75) Inventors: Jun Hak Lee, Suwon-si (KR); Dae Jin Myoung, Goyang-si (KR); Jung Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 10/995,316

(22) Filed: Nov. 24, 2004

(65) Prior Publication Data

US 2005/0110811 A1 May 26, 2005

(30) Foreign Application Priority Data

Nov. 26, 2003 (KR) ..... 10-2003-0084400
Dec. 16, 2003 (KR) ..... 10-2003-0091793

(51) Int. Cl.
*G09G 5/00* (2006.01)

(52) U.S. Cl. ..... 345/616; 345/428; 345/596; 345/597; 345/598; 345/600; 345/601; 345/639; 345/690; 345/691; 345/692; 382/167; 382/252

(58) Field of Classification Search ..... 345/598, 345/616, 639, 692
See application file for complete search history.

(56) References Cited

U.S. PATENT DOCUMENTS 5,570,461 A * 10/1996 Yokomizo ..... 345/616
5,790,704 A * 8/1998 Rao et al. ..... 382/237
6,069,609 A * 5/2000 Ishida et al. ..... 345/596
6,249,354 B1 * 6/2001 Nagatani ..... 358/1.9
6,476,824 B1 11/2002 Suzuki et al.
6,556,214 B1 * 4/2003 Yamada et al. ..... 345/616
6,771,832 B1 * 8/2004 Naito et al. ..... 382/252
6,795,085 B1 9/2004 Doherty et al.
6,831,618 B1 * 12/2004 Suzuki et al. ..... 345/60
6,956,583 B2 * 10/2005 Lee ..... 345/616
6,965,389 B1 * 11/2005 Masuji et al. ..... 345/690
7,109,950 B2 * 9/2006 Hirata et al. ..... 345/63
7,203,376 B2 * 4/2007 Takahashi et al. ..... 382/252
2002/0130825 A1 * 9/2002 Kang ..... 345/60
2003/0006994 A1 1/2003 Suzuki

FOREIGN PATENT DOCUMENTS

| | | |
|---|---|---|
| EP | 1 022 714 | 1/2000 |
| EP | 1 300 823 | 4/2003 |
| JP | 10-261080 | 9/1998 |
| KR | 10-2003-0033754 | 5/2003 |

OTHER PUBLICATIONS

Korean Office Action. Dated May 26, 2005.
European Search Report May 24, 2005.

* cited by examiner

*Primary Examiner*—Kee M. Tung
*Assistant Examiner*—Antonio A Caschera
(74) *Attorney, Agent, or Firm*—Ked & Associates, LLP

(57) ABSTRACT

A system and method for processing a gray level in a display device performs a random error diffusion operation on the video data using a first random coefficient value and a random dithering operation on the error-diffused video data using a second random coefficient value.

31 Claims, 12 Drawing Sheets

METHOD FOR PROCESSING A GRAY LEVEL IN A PLASMA DISPLAY PANEL AND APPARATUS USING THE SAME

This Nonprovisional application claims priority under 35 U.S.C. § 119(a) on Patent Application No. 10-2003-0084400 filed in Korea on Nov. 26, 2003 and No. 10-2003-0091793 filed in Korea on Dec. 16, 2003, the entire contents of which are hereby incorporated by reference.

BACKGROUND OF THE INVENTION

1. Field of the Invention

The present invention relates to a plasma display panel and, more particularly, to a method for processing video data of a plasma display panel in which error diffusion noise can be minimized while enhancing the power of gray level representation.

2. Description of the Background Art

Recently, a plasma display panel (hereinafter, referred to as PDP), which can be easily fabricated as a large-scale panel, has attracted public attention as a flat panel display device. The PDP is adapted to display an image by controlling a gas discharge period of each of pixels according to digital video data. A representative PDP is one, which has three electrodes and is driven as an AC voltage, as shown in FIG. 1.

FIG. 1 is a perspective view illustrating the structure of a discharge cell of a conventional PDP.

Referring to FIG. 1, the discharge cell of the AC type PDP includes a pair of sustain electrodes 12A, 12B formed on the bottom of an upper substrate 10, and a data electrode 20 formed on the top of a lower substrate 18.

Each of the pair of the sustain electrodes 12A, 12B includes a dual layer structure of a transparent electrode and a metal electrode. This pair of the sustain electrodes 12A, 12B includes a scan electrode 12A for mainly supplying a scan signal for an address discharge and a sustain signal for a sustain discharge, and a sustain electrode 12B for mainly supplying a sustain signal, while operating in turn with the scan electrode 12A. The data electrode 20 is formed to cross the pair of the sustain electrodes 12A, 12B and applies a data signal for the address discharge.

An upper dielectric layer 14 and a protection film 16 are laminated on the upper substrate 10 on which the pair of the sustain electrodes 12A, 12B are formed. A lower dielectric layer 22 is formed on the lower substrate 18 having the data electrode 20 formed thereon. The upper dielectric layer 14 and a lower dielectric layer 22 serve to accumulate electric charges generated by discharging. The protection film 16 serves to prevent the upper dielectric layer 14 from being damaged due to sputtering of plasma particles, and increase emission efficiency of secondary electrons upon discharging. These dielectric layers 14, 22 and the protection film 16 allow a driving voltage applied externally to lower.

Barrier ribs 24 are formed at the lower substrate 18 on which the lower dielectric layer 22 is formed. A phosphor layer 26 is formed on the lower dielectric layer 22 and the barrier ribs 24. The barrier ribs 24 serve to separate discharge spaces and prevent an ultraviolet ray generated by a gas discharge from leaking toward neighboring discharge spaces. The phosphor layer 26 is light-emitted by the ultraviolet ray generated by the gas discharge, producing red (hereinafter, referred to as green (hereinafter, referred to as G and blue (hereinafter, referred to as B visible rays. Furthermore, an insert gas for the gas discharge is inserted into the discharge spaces.

This discharge cell is selected by an address discharge by the data electrode 20 and the scan electrode 12A. The selected discharge cell sustains a discharge thereof by a sustain discharge of the pair of the sustain electrodes 12A, 12B. Furthermore, the discharge cell emits the phosphor layer 26 with the ultraviolet ray generated in the sustain discharge, so that the phosphor layer 26 produces R, G or B visible ray. In this case, the discharge cell implements the gray level necessary to display an image by controlling a sustain discharge period, i.e., the number of the sustain discharge according to the video data. Furthermore, a combination of three discharge cells on which the R, G and B phosphors 26 are coated implements colors of one pixel.

A representative method for driving this PDP is an ADS (Address and Display Separation) driving method in which the PDP is driven with it being divided into an address period and a display period, i.e., a sustain period.

FIG. 2 illustrates the configuration of sub-fields included in one frame in the prior art.

In the ADS driving method, one frame 1F is divided into a plurality of sub-fields SF1 to SF8 that correspond to bits of video data, respectively, as shown in FIG. 2. Each of the sub-fields SF1 to SF8 is subdivided into a reset period RPD for initializing a discharge cell, an address period APD for selecting a discharge cell, and a sustain period SPD for maintaining a discharge of the selected discharge cell.

In this time, different weight is assigned to the sub-fields SF1 to SF8 in the sustain period SPD, and the sustain period SPD is combined according to video data. Accordingly, the PDP can implement a corresponding gray level. Furthermore, the PDP employs an error diffusion method, etc. in order to enhance the power of gray level representation.

The error diffusion method includes calculating quantization error data of digital video data using the Floyd-Steinberg error diffusion filter, etc., and diffusing the calculated error data to neighboring pixels with them being assigned with different weight.

FIG. 3 is a diagram for explaining the error diffusion method in a prior art.

As shown in FIG. 3, in the error diffusion method, if an error diffusion operation is performed on a current pixel P5, error diffusion coefficient values for pixels P1 to P4, respectively, are calculated by assigning a weight of 1/16 to the pixel P1 adjacent to the pixel P5, a weight of 5/16 to the pixel P2, a weight of 3/16 to the pixel P3 and a weight of 7/16 to the pixel P4. Then, if the calculated error diffusion coefficient values, a carry signal to be added to the value of the current pixel P5 is found. As such, the current pixel value is found by adding this carry signal to the value of the current pixel P5.

This error diffusion method, however, has a problem that an error diffusion pattern is generated because error diffusion coefficients (i.e., weight) for neighboring pixels are set constantly and repeated every line and every frame.

Furthermore, there is a limit to the power of gray level representation of video data when only the existing error diffusion method is employed.

SUMMARY OF THE INVENTION

Accordingly, an object of the present invention is to solve at least the problems and disadvantages of the background art.

It is an object of the present invention to provide a method for processing a gray level in which error diffusion noise can be minimized while enhancing the power of gray level representation in a display device, and apparatus thereof.

To achieve the above object, according to the present invention, there is provided a method for processing video data in a display device, including the steps of: performing a random error diffusion operation on the video data, and performing a dithering operation on the error-diffused video data.

According to the present invention, there is provided an apparatus for processing video data, including a random error diffusion unit that performs a random error diffusion operation on the video data, and a dithering unit that performs a dithering operation on the error-diffused video data.

According to an embodiment of the present invention, there is provided a method for processing a gray level in a display device, including the steps of performing a random error diffusion operation on the video data using a first random coefficient value, and performing a random dithering operation on the error-diffused video data using a second random coefficient value.

According to an embodiment of the present invention, there is provided an apparatus for processing a gray level in a display device, including: a random error diffusion unit that performs a random error diffusion operation on the video data using a first random coefficient value, and a random dithering unit that performs a random dithering operation on the error-diffused video data using a second random coefficient value.

According to another embodiment of the present invention, there is provided a method for processing video data in a plasma display panel in which the number of bits of the video data is reduced through an error diffusion method and a dithering method, including the steps of: performing a random error diffusion operation on video data of a corresponding pixel using error conversion coefficients and a random error diffusion coefficient each calculated from pixels adjacent to the corresponding pixel, and performing a dithering operation on the random error-diffused video data using a plurality of dither mask patterns which are divided on a per gray level basis and on a per frame basis.

According to another embodiment of the present invention, there is provided an apparatus for processing video data of a display device in which the number of bits of the video data is reduced through an error diffusion method and a dither method, including: a random error diffusion unit that performs a random error diffusion operation on the video data of a corresponding pixel using error conversion coefficients and a random error diffusion coefficient which are calculated from pixels adjacent to the corresponding pixel, and a dithering unit that performs a dithering operation on the random error-diffused video data using a plurality of dither mask patterns which are divided on a per gray level basis and on a per frame basis.

The present invention is advantageous in that it can further improve the power of gray level representation and can minimize error diffusion noise.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
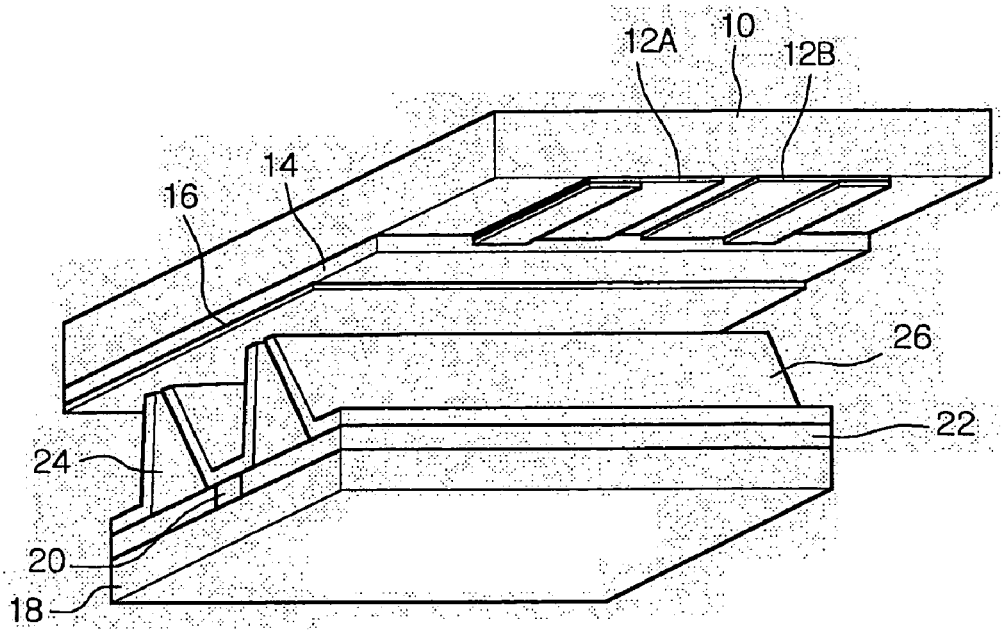
FIG. 1 is a perspective view illustrating the structure of a discharge cell of a conventional PDP.
Figure 2:
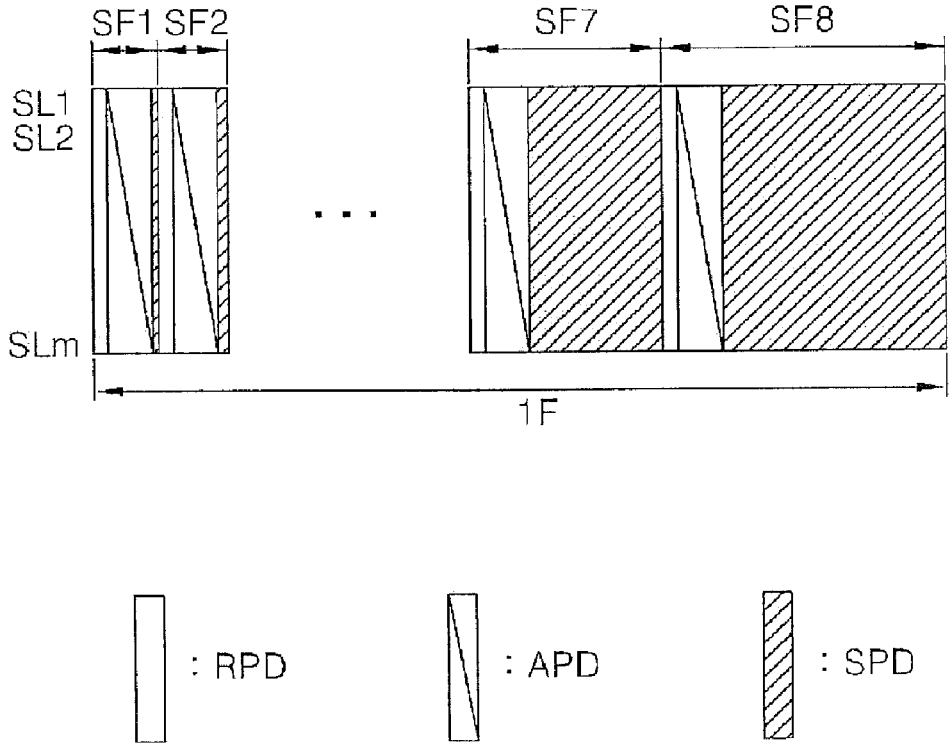
Fig. 2 RELATED ART
FIG. 2 illustrates the configuration of sub-fields included in one frame in the prior art.
Figure 3:
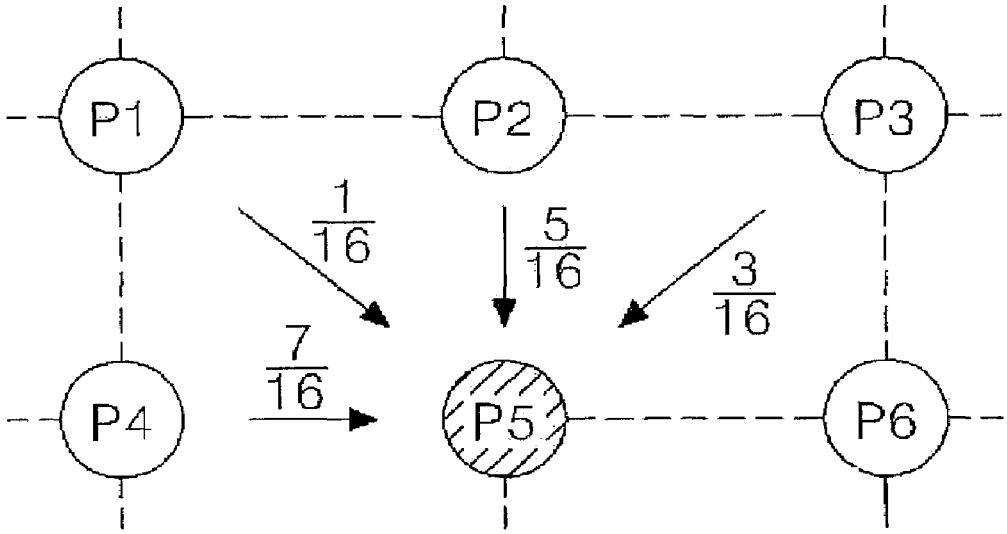
Fig. 3 RELATED ART
FIG. 3 is a diagram for explaining the error diffusion method in a prior art.

Preferred embodiments of the present invention will be described in a more detailed manner with reference to the drawings.

According to the present invention, there is provided a method for processing video data in a display device, including the steps of: performing a random error diffusion operation on the video data, and performing a dithering operation on the error-diffused video data.

According to the present invention, there is provided an apparatus for processing video data, including a random error diffusion unit that performs a random error diffusion operation on the video data, and a dithering unit that performs a dithering operation on the error-diffused video data.

According to an embodiment of the present invention, there is provided a method for processing a gray level in a display device, including the steps of performing a random error diffusion operation on the video data using a first random coefficient value, and performing a random dithering operation on the error-diffused video data using a second random coefficient value.

In the method for processing the video data in the display device according to an embodiment of the present invention, the video data is data in which the integer part of given bits undergoes inverse gamma correction and is then outputted as the integer part of given bits and the fraction part of given bits.

In the method for processing the video data in the display device according to an embodiment of the present invention, some upper bits among the fraction part of the given bits are used for the random dithering operation, and some lower bits among the fraction part of the given bits are used for the random error diffusion operation.

In the method for processing the video data in the display device according to an embodiment of the present invention, the step of performing the random error diffusion operation includes the steps of adding error diffusion coefficient values in which predetermined different weights are respectively assigned to error diffusion values of pixels adjacent to the video data, a current pixel value and a first random coefficient value, thus generating a carry signal, and adding a carry signal generated for the current pixel to the some upper bits.

In the method for processing the video data in the display device according to an embodiment of the present invention, the steps are performed on the respective pixels of the video data in the same manner.

In the method for processing the video data in the display device according to an embodiment of the present invention, the step of performing the random dithering operation includes the steps of selecting a dither mask pattern corresponding to a gray level value of video data in which a carry signal is reflected, performing an XOR operation on the second random coefficient value and a dither value of the selected dither mask pattern, and adding the XORed value to the gray level value of the video data in which the carry signal is reflected.

In the method for processing the video data in the display device according to an embodiment of the present invention, the dither value of the selected dither mask pattern is outputted according to a combination of a vertical sync signal, a horizontal sync signal and a pixel clock signal.

In the method for processing the video data in the display device according to an embodiment of the present invention, the dither mask pattern is set every gray level and every frame.

According to an embodiment of the present invention, there is provided an apparatus for processing a gray level in a display device, including: a random error diffusion unit that performs a random error diffusion operation on the video data using a first random coefficient value, and a random dithering unit that performs a random dithering operation on the error-diffused video data using a second random coefficient value.

In the apparatus for processing the gray level in the display device according to an embodiment of the present invention, the apparatus further includes a gamma correction unit that performs an inverse gamma correction operation on the integer part of the video data as the integer part of given bits and the fraction part of given bits.

In the apparatus for processing the gray level in the display device according to an embodiment of the present invention, the fraction part of the given bits are composed of some upper bits and some lower bits, the some upper bits are used for a random dithering operation, and the some lower bits are used for a random error diffusion operation.

In the apparatus for processing the gray level in the display device according to an embodiment of the present invention, the apparatus further includes a random generating unit that generates random coefficient values, which will be provided to the random error diffusion unit and the random dithering unit.

In the apparatus for processing the gray level in the display device according to an embodiment of the present invention, the random error diffusion unit adds error diffusion coefficient values in which predetermined different weights are respectively assigned to error diffusion values of pixels adjacent to the video data, a current pixel value and the first random coefficient value, thus generating a carry signal, and adds a carry signal generated for the current pixel to the some upper bits.

In the apparatus for processing the gray level in the display device according to an embodiment of the present invention, the random dithering unit includes a dither mask table that selects a dither mask pattern corresponding to a gray level value of video data in which a carry signal is reflected, an XOR gate that performs an XOR operation on the second random coefficient value and a dither value of the selected dither mask pattern, and an adder that adds the XORed value to the gray level value of the video data in which the carry signal is reflected.

In the apparatus for processing the gray level in the display device according to an embodiment of the present invention, the dither value of the selected dither mask pattern is outputted according to a combination of a vertical sync signal, a horizontal sync signal and a pixel clock signal.

In the apparatus for processing the gray level in the display device according to an embodiment of the present invention, the dither mask pattern is set every gray level and every frame.

According to another embodiment of the present invention, there is provided a method for processing video data in a plasma display panel in which the number of bits of the video data is reduced through an error diffusion method and a dithering method, including the steps of: performing a random error diffusion operation on video data of a corresponding pixel using error conversion coefficients and a random error diffusion coefficient each calculated from pixels adjacent to the corresponding pixel, and performing a dithering operation on the random error-diffused video data using a plurality of dither mask patterns which are divided on a per gray level basis and on a per frame basis.

In the method for processing the video data in the plasma display panel according to another embodiment of the present invention, the inputted video data is an inverse gamma corrected video data.

In the method for processing the video data in the plasma display panel according to another embodiment of the present invention, the step of performing the random error diffusion operation includes the steps of adding some lower bits of the inputted video data, error diffusion coefficients calculated by assigning different weights to data of the neighboring pixels, and the random error diffusion coefficient to produce a carry signal, and adding the carry signal to the remaining upper bits of the inputted video data.

In the method for processing the video data in the plasma display panel according to another embodiment of the present invention, the step of performing the random error diffusion operation includes the steps of adding some lower bits of the inputted video data, error diffusion coefficients that re calculated by assigning different weights to data of the neighboring pixels, and a random diffusion coefficient, which substitutes any one of the error diffusion coefficients, to produce a carry signal, and adding the carry signal to the remaining upper bits of the inputted video data.

In the method for processing the video data in the plasma display panel according to another embodiment of the present invention, the step of performing the dithering operation includes the steps of selecting a dither mask pattern of a corresponding gray level among the plurality of the dither mask patterns using lower bits of some the random error-diffused video data, selecting a dither value at a position corresponding to the random error-diffused video data among the selected dither mask pattern, and adding the selected dither value to upper bits of the remaining some of the random error-diffused video data.

In the method for processing the video data in the plasma display panel according to another embodiment of the present invention, the step of selecting the dither value includes the step of counting a vertical sync signal, a horizontal sync signal and a pixel clock signal inputted from the outside, and selecting a position corresponding to the random error-diffused video data using the counted signals.

In the method for processing the video data in the plasma display panel according to another embodiment of the present invention, the step of selecting the dither value includes the step of selecting dither mask patterns of a corresponding gray level, which are different by the frame, while toggling the dither mask patterns, using the counted signal of the vertical sync signal.

In the method for processing the video data in the plasma display panel according to another embodiment of the present invention, dither mask patterns corresponding to the same gray level and frame among the plurality of the dither mask patterns are different by read, green and blue pixels.

In the method for processing the video data in the plasma display panel according to another embodiment of the present invention, bits among the video data used for the step of performing the random error diffusion operation are lower bits of bits used for the step of performing the dithering operation.

According to another embodiment of the present invention, there is provided an apparatus for processing video data of a display device in which the number of bits of the video data is reduced through an error diffusion method and a dither method, including: a random error diffusion unit that performs a random error diffusion operation on the video data of a corresponding pixel using error conversion coefficients and a random error diffusion coefficient which are calculated from pixels adjacent to the corresponding pixel, and a dithering unit that performs a dithering operation on the random error-diffused video data using a plurality of dither mask patterns which are divided on a per gray level basis and on a per frame basis.

In the apparatus for processing the video data of the display device according to another embodiment of the present invention, the apparatus further includes an inverse gamma correction unit that performs an inverse gamma correction operation on the inputted video data.

In the apparatus for processing the video data of the display device according to another embodiment of the present invention, the random error diffusion unit adds some lower bits of the input video data, error diffusion coefficients calculated by assigning different weights to data of the neighboring pixels, and the random error diffusion coefficient to produce a carry signal, and adds the carry signal to the remaining upper bits of the inputted video data.

In the apparatus for processing the video data of the display device according to another embodiment of the present invention, the random error diffusion unit adds some lower bits of the input video data, error diffusion coefficients calculated by assigning different weights to data of the neighboring pixels, and a random diffusion coefficient which substitutes any one of the error diffusion coefficients to produce a carry signal, and adds the carry signal to the remaining upper bits of the inputted video data.

In the apparatus for processing the video data of the display device according to another embodiment of the present invention, the dithering unit includes a dither mask table that stores a plurality of dither mask patterns and selects a dither value corresponding to the random error-diffused video data among the stored dither mask patterns, a mask control unit that indicates a position where the dither mask table corresponds to the random error-diffused video data, and an adder that adds the dither value to the random error-diffused video data and outputs the added dither value.

In the apparatus for processing the video data of the display device according to another embodiment of the present invention, the mask control unit counts a vertical sync signal, a horizontal sync signal and a pixel clock signal received from the outside, and selects a position corresponding to the random error-diffused video data using the counted signal.

In the apparatus for processing the video data of the display device according to another embodiment of the present invention, the mask control unit selects dither mask patterns of a corresponding gray level, which are different by the frame, while toggling the dither mask patterns, using the counted signal of the vertical sync signal.

In the apparatus for processing the video data of the display device according to another embodiment of the present invention, the dither mask table belongs to the same gray level and frame and further includes different dither mask patterns by the read, green and blue pixels.

In the apparatus for processing the video data of the display device according to another embodiment of the present invention, bits among the video data used for the random error diffusion unit are lower bits of bits used for the dithering unit.

Figure 4:
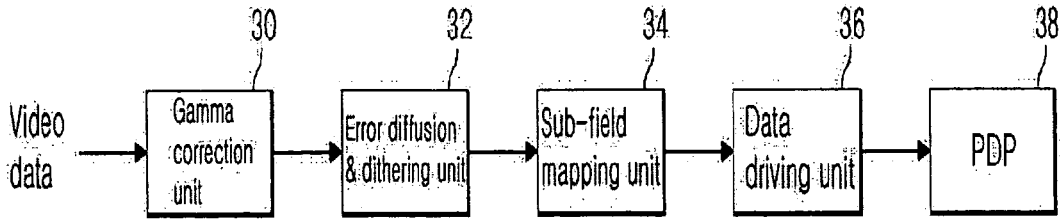
FIG. 4 is a schematic block diagram showing an apparatus for processing a gray level in a PDP according to the present invention.

FIG. 4 is a schematic block diagram showing an apparatus for processing a gray level in a PDP according to the present invention.

Referring to FIG. 4, the apparatus includes a gamma correction unit 30, an error diffusion and dithering unit 32, a sub-field mapping unit 34 and a data driving unit 36, which are connected between an input line of video data and a PDP 38.

To the gamma correction unit 30 is inputted gamma-corrected digital video data so that they are suitable for a brightness characteristic of a cathode ray tube (CRT), i.e., pixel values which will be provided to pixels, respectively, from the outside. The gamma correction unit 30 performs an inverse gamma correction operation on the received pixel values so that brightness characteristics of the pixel values have the linearity.

Figure 6:
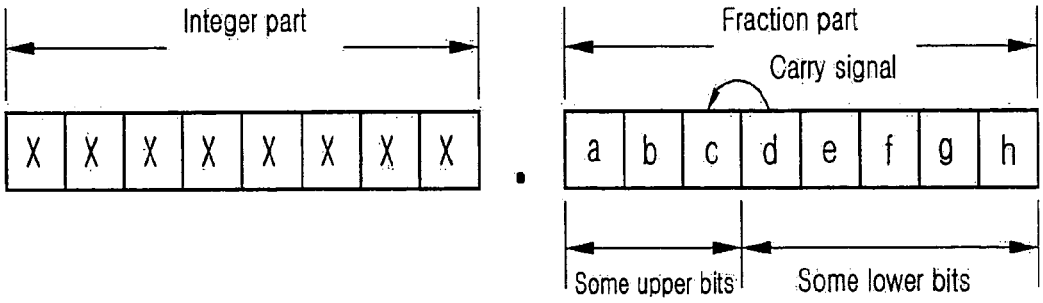
FIG. 6 is a diagram illustrating the configuration of bits of video data outputted from the gamma correction unit shown in FIG. 4.

For example, the gamma correction unit 30 can output an inverse gamma correction pixel value corresponding to an input pixel value using a predetermined look-up table (LUT) so that a brightness characteristic depending on the pixel value complies with the 2.2 gamma curve. In this case, each of the pixel values outputted from the gamma correction unit 30 consists of the integer part and the fraction part. For example, as shown in FIG. 6, if an 8-bit pixel value is received, the gamma correction unit 30 outputs a 16-bit inverse gamma corrected pixel value, which is composed of an integer part of 8 bits and a fraction part of 8 bits. In this time, the 8-bit fraction part includes some upper bits used for random error diffusion and some lower bits used for random dithering. If the power of gray level representation is to be enhanced, more many upper bits and lower bits can be used.

The error diffusion and dithering unit 32 corrects the pixel values received from the gamma correction unit 30 through error diffusion and dithering, and then outputs the pixel values the number of bits is reduced but the power of gray level representation is enhanced. That is, the error diffusion and dithering unit 32 performs the error diffusion operation on the inverse gamma corrected pixel values using a first random coefficient value and also performs the dithering operation on the error-diffused pixel values using a second random coefficient value. In this time, if the inverse gamma corrected pixel values are error-diffused using the first random coefficient value, a given carry signal is generated. The carry signal generated thus is added to some upper bits of a fraction part of video data and is then dithered.

As such, by adding the random coefficient values in the error diffusion and dithering operations, it is possible to prevent an error diffusion pattern from occurring due to constant error diffusion coefficients. Furthermore, the error diffusion and dithering unit 32 performs the random error diffusion operation using lower bits of bits used for the dithering operation. Thus, a step between dithering patterns is subdivided and more many gray levels can be represented accordingly. Detailed description on the error diffusion and dithering unit 32 will be given later on.

The sub-field mapping unit 34 maps the pixel values received from the error diffusion and dithering unit 32 to predetermined sub-field patterns.

The data driving unit 36 latches data, which is classified on a per bit basis according to a sub-field pattern in the sub-field mapping unit 34, and then supplies the latched data for one line to address electrode lines of the PDP 38 every period where one horizontal line is driven.

The PDP 38 includes the address electrode lines, and sustain electrode line pairs that cross the address electrode lines with discharge spaces therebetween. Furthermore, each of cells having the discharge spaces corresponding to sub-pixels is formed at each of the intersections of the address electrode lines and the sustain electrode line pairs. This PDP 38 selects cells which will be turned on with an address discharge depending on data, which is supplied from the data driving unit 36 to the address electrode lines whenever the scan electrode lines among the sustain electrode line pairs are driven in an address period of each of the sub-fields.

Furthermore, the PDP 38 allows the selected cells to maintain their discharge in a sustain period of each of the sub-fields by allowing the sustain electrode line pairs to drive. In this case, the number of sub-fields constituting one frame is reduced as many as the number of bits of video data, which are reduced by the error diffusion and dithering unit 32. Since the address period can be sufficiently secured, the PDP 38 can be driven in a single scan method.

Figure 5:
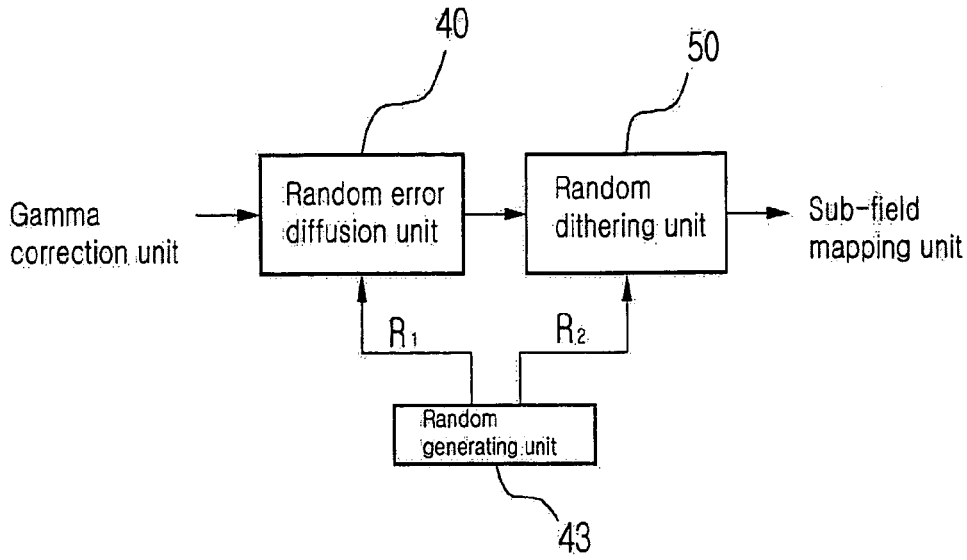
FIG. 5 is a detailed block diagram showing the error diffusion and dithering unit according to an embodiment of the present invention.

FIG. 5 is a detailed block diagram showing the error diffusion and dithering unit according to an embodiment of the present invention. FIG. 6 is a diagram illustrating the configuration of bits of video data outputted from the gamma correction unit shown in FIG. 4.

Referring to FIG. 5, the error diffusion and dithering unit 32 includes a random generating unit 43, a random error diffusion unit 40 and a random dithering unit 50.

The random generating unit 43 generates given random coefficient values R1, R2, and supplies the values to the random error diffusion unit 40 and the random dithering unit 50. These random coefficient values R1, R2 are used for the random error diffusion operation and the dithering operation, respectively.

The random error diffusion unit 40 generates a carry signal, by adding error diffusion coefficient values obtained by assigning predetermined different weights to the video data received from the gamma correction unit 30, a current pixel value and a random coefficient value.

Figure 7:
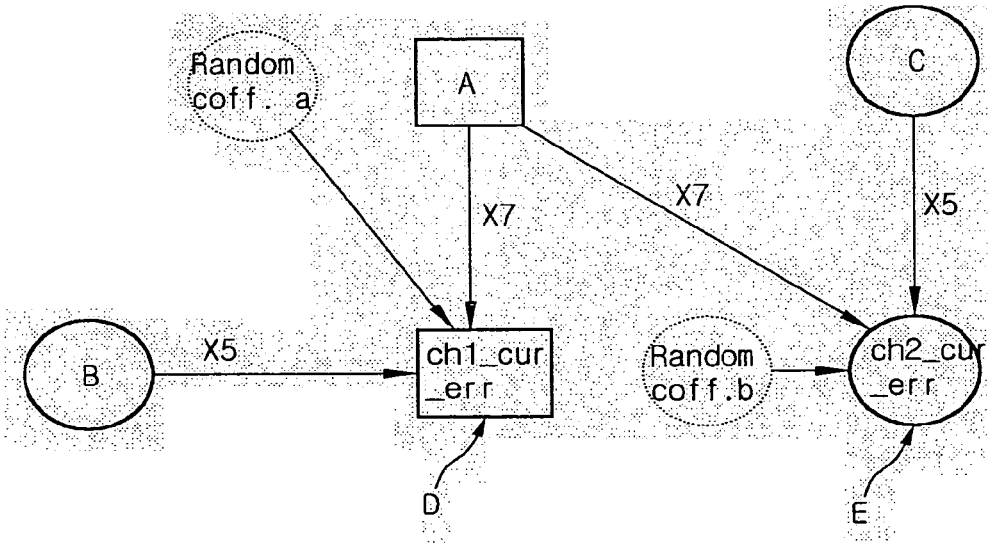
FIG. 7 is a diagram for explaining a random error diffusion method in the random error diffusion unit shown in FIG. 5.

FIG. 7 is a diagram for explaining a random error diffusion method in the random error diffusion unit shown in FIG. 5.

Referring to FIG. 7, a carry value of a current pixel D from a pixel A and a pixel B adjacent to the pixel D, and a carry value of a carry value of a pixel E from the pixel A and a pixel C adjacent to the pixel E can be expressed into the following equation.

$$\text{E.D Carry ch1}(D)=\text{Random coff. } a+A\times 7+B\times 5+\text{ch1_cur_err}$$

$$\text{E.D Carry ch2}(E)=\text{Random coff. } b+A\times 7+C\times 5+\text{ch2_cur_err}$$

(where, Random coff. a and Random coff. b indicate a random coefficient value R1 generated by the random generating unit 43, A, B and C indicate random error diffusion values of the pixels A, B and C, respectively, and ch1_cur_err and ch2_cur_err indicate current pixel values of the pixel D and the pixel E, respectively).

As expressed in the equation, the carry signal is generated by adding error diffusion coefficient values calculated by assigning different weights to neighboring current error diffusion values, the random coefficient value R1 generated by the random generating unit, and a current pixel value.

For example, in a random error diffusion value of the pixel D, a weight 7 is assigned to lower 5 bits of a fraction part of its neighboring pixel A and a weight 5 is assigned to lower 5 bits of a fraction part of its neighboring pixel B, as show in the equation 1. These values assigned thus are calculated by adding the random coefficient value R1 outputted from the random generating unit and the pixel value of the pixel D. In this time, the most significant bit (LSB) of the lower 5 bits generates a carry signal "0" or "1". The generated carry signal is added to upper 3 bits of a fraction part of the pixel D, so that a random error diffusion value of a total 11 bits (the integer part 8 bits+the fraction part 3 bits) is outputted to the random dithering unit 50.

The random dithering unit 50 dithers the random error diffusion value received from the random error diffusion unit 40 through the dither mask pattern, and then outputs a pixel value the number of bits is reduced to the sub-field mapping unit 34.

Figure 8:
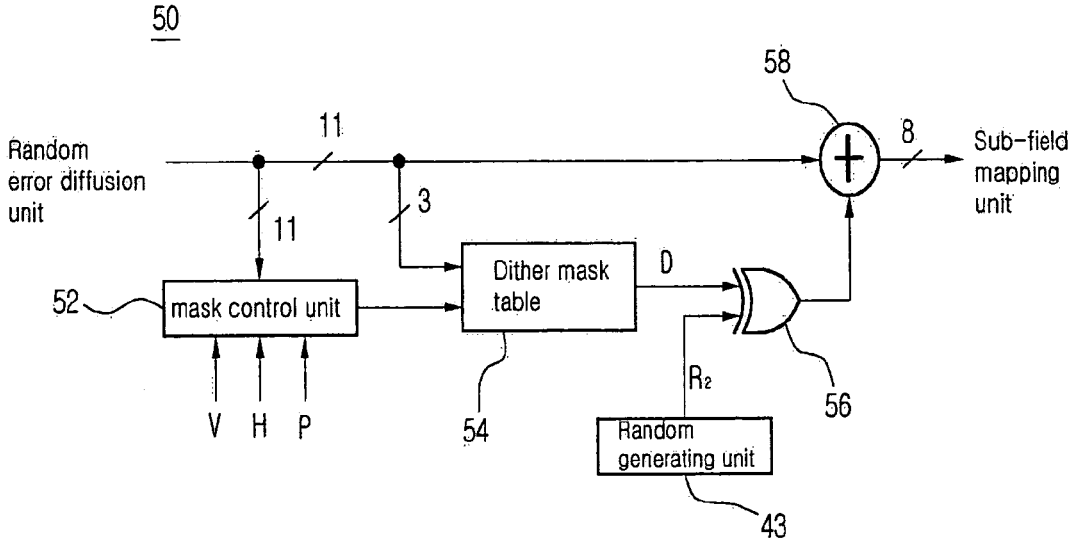
FIG. 8 is a circuit diagram showing the random dithering unit shown in FIG. 5.

FIG. 8 is a circuit diagram showing the random dithering unit shown in FIG. 5.

Referring to FIG. 8, the random dithering unit 50 includes a dither mask control unit 52, a dither mask table 54, an XOR gate 56 and an adder 58.

The dither mask table 54 stores different dither mask patterns on a per gray level basis and on a per frame basis. In this time, the random generating unit 43 generates given random coefficient values R1, R2 and supplies the values to the random error diffusion unit 40 and the random dithering unit 50, as described above. These random coefficient values R1, R2 are used for the random error diffusion operation and the dithering operation, respectively.

Figure 9:
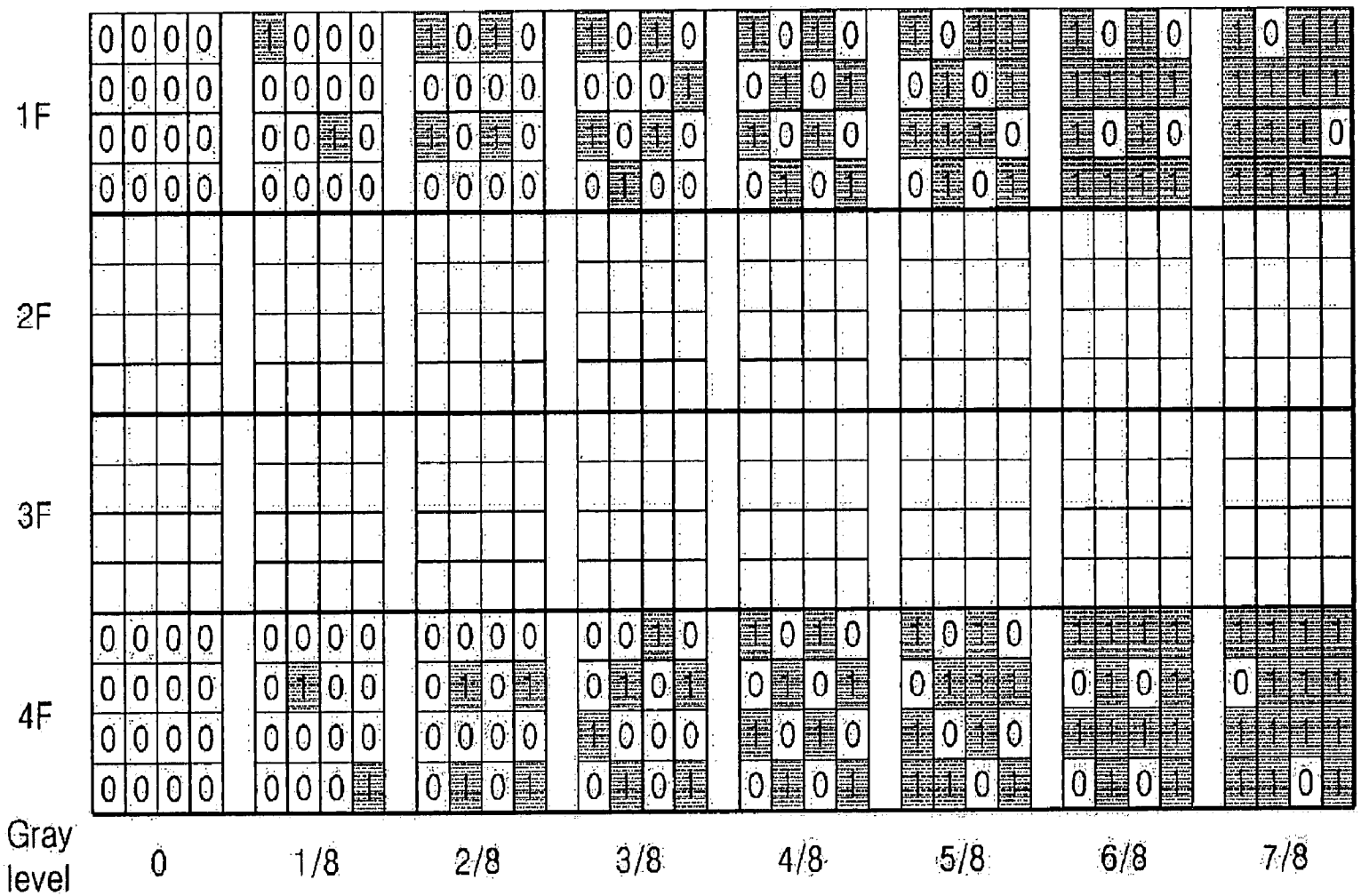
FIG. 9 is a view showing dither mask patterns stored in the dither mask table of FIG. 8.

FIG. 9 is a view showing dither mask patterns stored in the dither mask table of FIG. 8.

Referring to FIG. 9, the dither mask patterns having of a cell (sub-pixel) size of 4×4 are classified by 8 gray levels like 0 to ⅞ corresponding to upper 3 bits of a fraction part of a random error diffusion value. The 8 dither mask patterns are classified by four frames 1F to 4F. Thus, a total of 32 dither mask patterns is stored in the dither mask table 54.

Dither mask patterns that are set to '0' or '1' in frames 2 and 3 are not shown in FIG. 8. It is, however, to be noted that the dither mask patterns can be set to '0' or '1' even in the frames 2 and 3 in the same manner as in frame 1 and 4.

From FIG. 9, it can be seen that the number of cells, which are set to the dither value "1" in the dither mask patterns of 0, ⅛, ⅜, ⅜, ⅜, ⅝, ⅝, ⅞ and ⅞ gray levels, increases in order of 0, 2, 4, 6, 8, 10, 12 and 14 in number. It can be also known that the positions of the cells set to the dither value "1" by four frames 1F to 4F are different. In each of the dither mask patterns, the position of "1" can be changed by a designer, if needed. It is thus possible to control the position of an on-cell corresponding to the dither value "1" according to this dither mask pattern in space and time. Furthermore, since the position of the dither value "1" varies by the gray level and by the frame in the dither mask patterns, error diffusion noise such as grating noise, which is caused by repetition of a constant dither mask pattern, can be reduced. Moreover, the dither mask table 54 can store different dither mask patterns by the R (read), G (green) and B (blue) pixel in order to further reduce noise due to the dither mask pattern.

The dither mask table 54 that stores the dither mask patterns receives a random error diffusion value from the random error diffusion unit 40, for example, upper 3 bits of a fraction part among a pixel value of 11 bits (integer part 8 bits+fraction part 3 bits), and selects a dither mask pattern corresponding the upper 3-bit gray level.

In other words, the dither mask table 54 selects a dither mask pattern of a gray level corresponding to the received lower 3 bits from the dither mask patterns as shown in FIG. 9. Then, the dither mask table 54 selects a dither value D corresponding to a frame and the position of a cell indicated by the mask control unit 52, among the dither mask patterns of the selected gray level, and then outputs the dither value D to the XOR gate 56. Meanwhile, the XOR gate 56 receives the second random coefficient value R2 from the random generating unit.

The dither mask control unit 52 counts a vertical sync signal V that is received from an external controller (not shown) to indicate a corresponding frame of the four frames 1F to 4F, counts a horizontal sync signal H and a pixel clock signal P to indicate a horizontal line and a vertical line within a corresponding frame, i.e., the position of a cell.

The XOR gate 56 performs an XOR operation on the dither mask pattern received from the dither mask table 54 and the second random coefficient value R2 received from the random generating unit 43, and then outputs the results to the adder 58.

As well noted, in the XOR operation, if input values are different, a value of '1' is outputted, and if the input values are the same, a value of '0' is outputted.

The adder 58 adds the output value received from the XOR gate 56 to the random error diffusion value received from the random error diffusion unit 40, and then supplies the added value to the sub-field mapping unit 34.

As stated previously, according to the method and apparatus for processing the gray level in the display device of the present invention, the random error diffusion unit 40 and the random dithering unit 50 perform the random error diffusion operation and the random dithering operation, respectively, on a pixel value, which is expanded from initial 8 bits to 16 bits through inverse gamma correction. Therefore, since random error diffusion values are outputted randomly, noise such as pattern depending on error diffusion can be removed.

Figure 10:
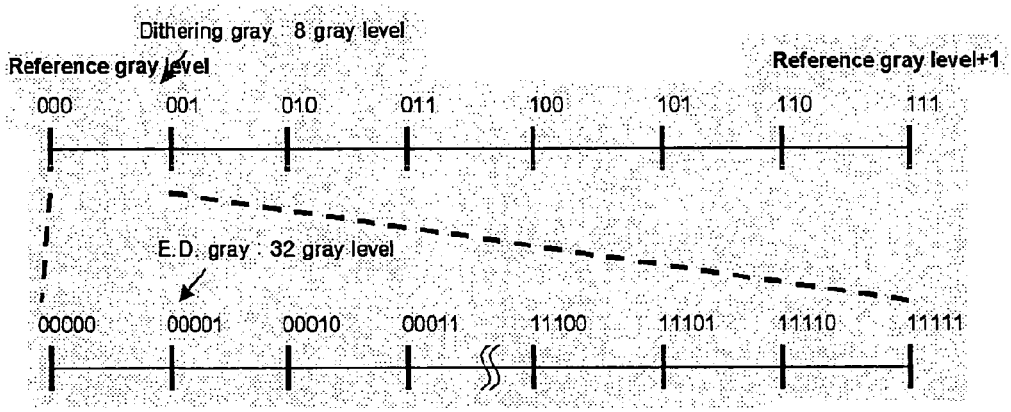
FIG. 10 is a view for explaining that the power of gray level representation is enhanced by the error diffusion and dithering unit of FIG. 4.

Furthermore, according to the method and apparatus for processing the gray level in the display device in accordance with the present invention, the number of gray level which can be represented can be increased by subdividing gray levels between basic gray levels using the dither mask patterns as shown in FIG. 9 through the dithering of the random dithering unit 50. This is made possible by a combination of data 1, which is variously distributed in space and time like the dither mask patterns shown in FIG. 9. For example, in the present invention, basic 256 gray levels can be implemented using a 8-bit pixel value produced through the error diffusion and dithering operations. If 8 gray levels are implemented through the dithering operation and 32 gray levels are implemented through the random error diffusion operation as shown in FIG. 10, a total of 216 gray levels can be represented.

Figure 11:
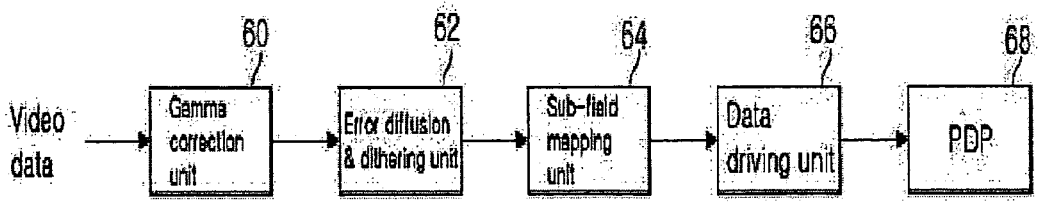
FIG. 11 is a schematic block diagram showing an apparatus for processing video data in a PDP according to another embodiment of the present invention.

FIG. 11 is a schematic block diagram showing an apparatus for processing video data in a PDP according to another embodiment of the present invention.

Referring to FIG. 11, the apparatus according to another embodiment of the present invention includes a gamma correction unit 60, an error diffusion and dithering unit 62, a sub-field mapping unit 64 and a data driving unit 66, which are connected between an input line of video data and a PDP 68. It can be seen that the apparatus of FIG. 11 is the same as that of FIG. 4.

Unlike FIG. 4, however, the error diffusion and dithering unit 62 of FIG. 11 corrects pixel data received from the gamma correction unit 60 through an error diffusion operation and a dithering operation using dither mask patterns, and then outputs pixel data the power of gray level representation is improved but the number of bits is reduced. In this case, the error diffusion and dithering unit 62 adds a random error diffusion coefficient (hereinafter, referred to as -ED coefficient') for preventing an error diffusion pattern from occurring due to constant error diffusion coefficients to the error diffusion operation. Furthermore, the error diffusion and dithering unit 62 can subdivide a step between dithering patterns by performing the random error diffusion operation using lower bits of bits, which are used for the dithering operation. Accordingly, more many gray levels can be represented. Detailed description on the error diffusion and dithering unit 62 will be given later on.

The construction of the apparatus shown in FIG. 11 is the same as those of FIG. 4 except for the error diffusion and dithering unit 62. Thus, detailed description on the remaining components will not be given in order to avoid redundancy.

Figure 12:
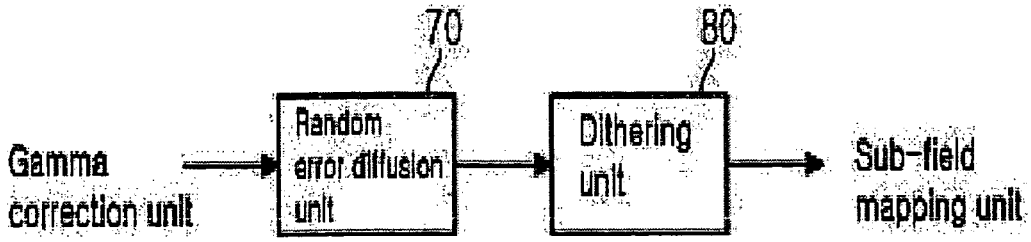
FIG. 12 is a schematic block diagram showing the construction of the error diffusion and dithering unit shown in FIG. 11.
Figure 13:
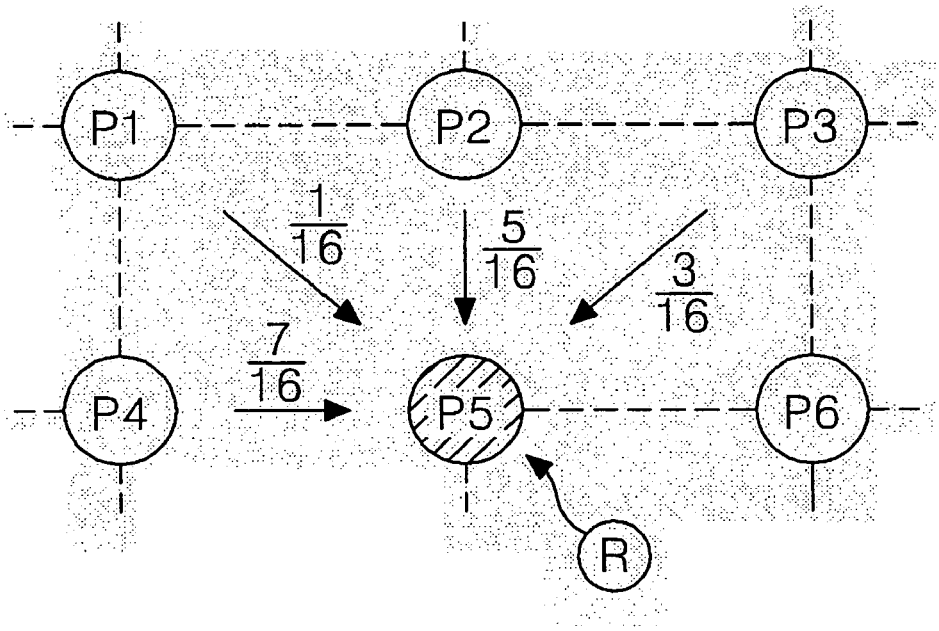
FIG. 13 is a view for explaining a random error diffusion method of the random error diffusion unit shown in FIG. 12.

FIG. 12 is a schematic block diagram showing the construction of the error diffusion and dithering unit shown in FIG. 11. FIG. 13 is a view for explaining a random error diffusion method of the random error diffusion unit shown in FIG. 12.

Referring to FIG. 12, the error diffusion and dithering unit 62 includes a random error diffusion unit 70 and a dithering unit 80. The random error diffusion unit 70 performs an error diffusion operation on video data received from the gamma correction unit 60 and error diffusion coefficients of neighboring pixels, which are calculated through an error diffusion filter, and then outputs pixel data the number of bits is reduced. In this case, the random error diffusion unit 70 adds the R-ED coefficient for preventing the error diffusion pattern from occurring due to constant error diffusion coefficients to the error diffusion operation. To this end, the random error diffusion unit 70 includes an error diffusion filter, and a R-ED coefficient generator connected to the error diffusion filter.

For example, as shown in FIG. 13, in the case where the error diffusion operation on a current pixel P5 is performed, the error diffusion filter calculates error diffusion coefficients for respective pixels P1 to P4, by assigning a weight of 1/16 to some of a fraction part (lower 5 bits of 8-bit fraction part) of a pixel P1 adjacent to the pixel P5, a weight of 5/16 to some of a fraction part of the pixel P2, a weight of 3/16 to some of a fraction part of the pixel P3, and a weight of 7/16 to some of a fraction part of the pixel P4. The error diffusion filter then generates a first carry signal "0" or "1" by adding a R-ED coefficient R received from the R-ED coefficient generator to the calculated error diffusion coefficients, or replacing any one of the calculated error diffusion coefficients with a R-ED coefficient R received from the R-ED coefficient generator and then adding the R-ED coefficient R to some of a fraction part of the current pixel P5 data (lower 5 bits of a fraction part). Furthermore, the error diffusion filter adds the first carry signal to the remaining bits (integer part 8 bits+fraction part 3 bits) of the current pixel data to produce pixel data of 11 bits.

The dithering unit 80 dithers the pixel data received from the random error diffusion unit 70 through a dither mask pattern, and then outputs the pixel data the number of bits is reduced to the sub-field mapping unit 34.

Figure 14:
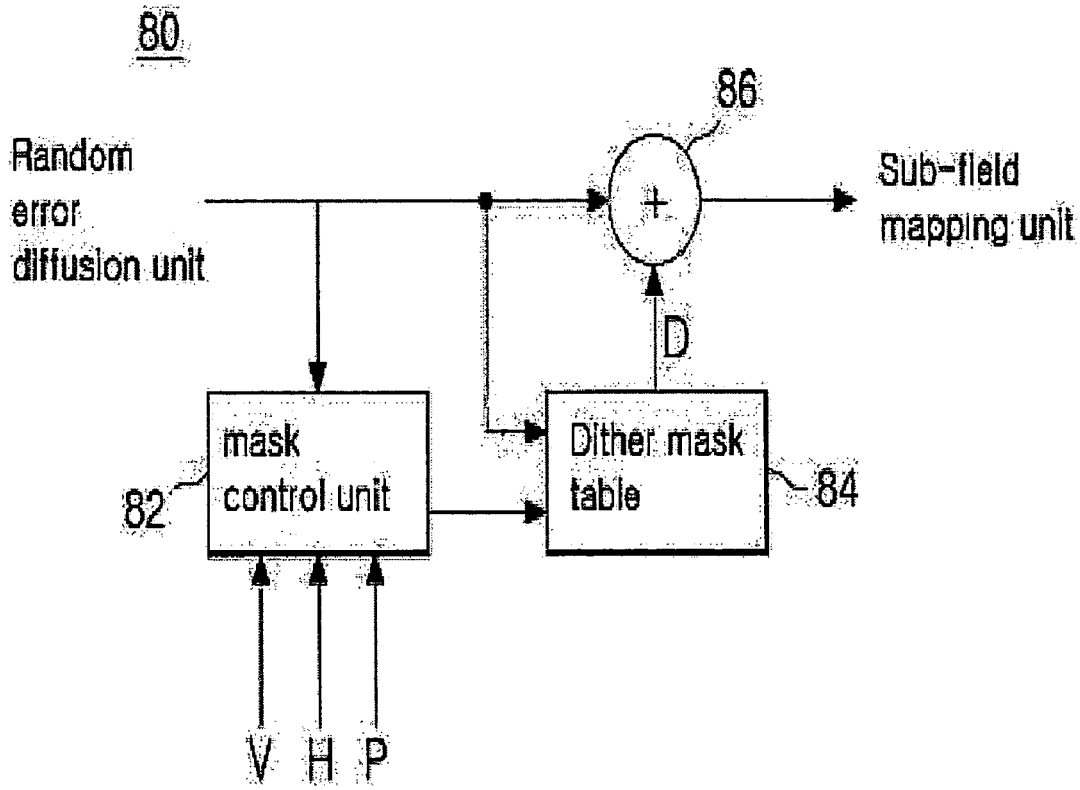
FIG. 14 is a detailed circuit diagram showing the dithering unit shown in FIG. 11.

FIG. 14 is a detailed circuit diagram showing the dithering unit shown in FIG. 11.

Referring to FIG. 14, the dithering unit 80 includes a dither mask table 84 connected to a dither mask control unit 82 and an output line of the random error diffusion unit 80, and an adder 86 connected to the dither mask table 84 and the output line of the random error diffusion unit 80.

The dither mask table 84 stores different dither mask patterns on a per gray level basis and on a per frame basis.

Figure 15:
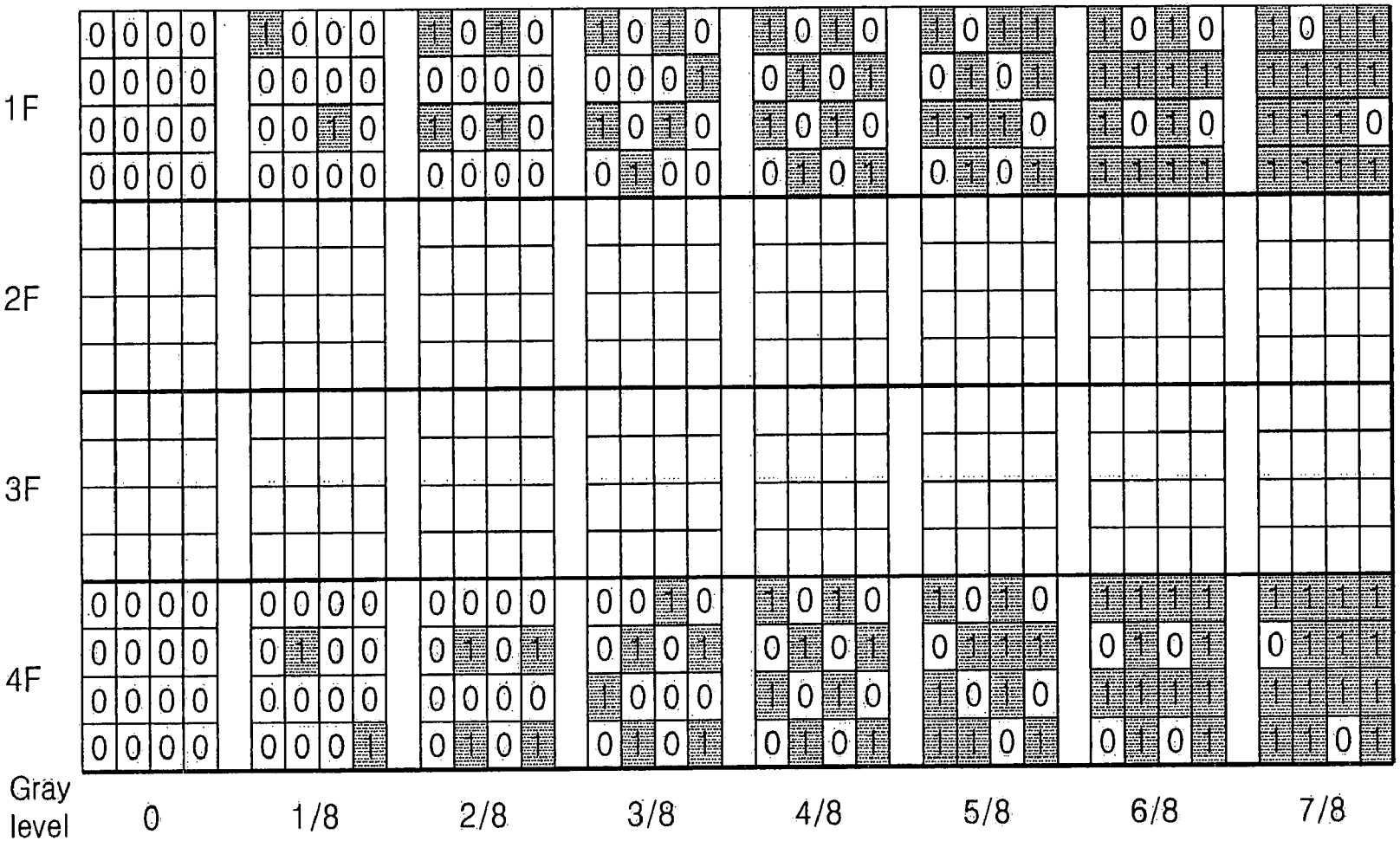
FIG. 15 is a view showing dither mask patterns in a cell unit, which are stored in the dither mask table shown in FIG. 14.

FIG. 15 is a view showing dither mask patterns in a cell unit, which are stored in the dither mask table shown in FIG. 14.

Referring to FIG. 15, the dither mask patterns having a sub-pixel size of 4×4 are divided on a per gray level basis like 0 to ⅞ corresponding to lower 3 bits of pixel data. Each of the 8 dither mask patterns is divided by four frames 1F to 4F. Thus, the dither mask table 84 stores a total of 32 dither mask patterns. From FIG. 15, it can be seen that the number of cells, which are set to the dither value "1" in the dither mask patterns of 0, ⅛, ⅜, ⅜, ⅝, ⅝, ⅞ and ⅞ gray levels, increases in order of 0, 2, 4, 6, 8, 10, 12 and 14 in number. It can be also known that the positions of the cells set to the dither value "1" by four frames 1F to 4F are different. In each of the dither mask patterns, the position of "1" can be changed by a designer, if needed. It is thus possible to control the position of an on-cell corresponding to the dither value "1" according to this dither mask pattern in space and time. Furthermore, since the position of the dither value "1" varies by the gray level and by the frame in the dither mask patterns, error diffusion noise such as grating noise, which is caused by repetition of a constant dither mask pattern, can be reduced. Moreover, the dither mask table 54 can store different dither mask patterns by the R (read), G (green) and B (blue) pixel in order to further reduce noise due to the dither mask pattern.

The dither mask table 84 that stores the dither mask patterns receives a random error diffusion value from the random error diffusion unit 80, for example, upper 3 bits of a fraction part among a pixel value of 11 bits (integer part 8 bits+ fraction part 3 bits), and selects a dither mask pattern corresponding the upper 3-bit gray level. The dither mask table 84 then selects a dither mask pattern of a gray level corresponding to the received lower 3 bits from the dither mask patterns as shown in FIG. 15. Next, the dither mask table 84 selects a dither value D2 corresponding to a frame and the position of a cell, which are indicated by the mask control unit 82, from the selected dither mask pattern of the gray level, and then outputs the selected dither value D2 to the adder 86.

To this end, the dither mask control unit 82 counts a vertical sync signal V received from an external controller (not shown) to indicate a corresponding frame among the four frames 1F to 4F, and counts a horizontal sync signal H and a pixel clock signal P to indicate a horizontal line and a vertical line within the corresponding frame, i.e., the position of a cell. In this case, the dither mask control unit 82 allows the dither mask table 84 to select dither mask patterns of a corresponding gray level, while toggling the first to fourth frame 1F to F4 using the vertical sync signal V.

The adder 86 adds the dither value D received from the dither mask table 84 to data of upper 8 bits except for the lower 3 bits of the pixel data received from the random error diffusion unit 80 as a carry signal, and then supplies the 8-bit pixel data to the sub-field mapping unit 64.

As such, according to the method and apparatus for processing the video data in the PDP in accordance with another embodiment of the present invention, the random error diffusion unit 70 and the dithering unit 80 perform the random error diffusion and dithering operations on pixel data, which is expanded from initial 8 bits to 16 bits through inverse gamma correction, whereby the pixel data is outputted as 8-bit pixel data. Basic 256 gray levels can be represented using this 8-bit pixel data. Furthermore, according to the method and apparatus for processing the video data in the PDP in accordance with another embodiment of the present invention, the number of gray levels, which can be represented, can be increased by subdividing gray levels between basic gray levels using the dither mask patterns as shown in FIG. 15 through the dithering operation of the dithering unit 80. This is made possible by a combination of data 1, which is variously distributed in space and time, like the dither mask patterns shown in FIG. 15.

Figure 16:
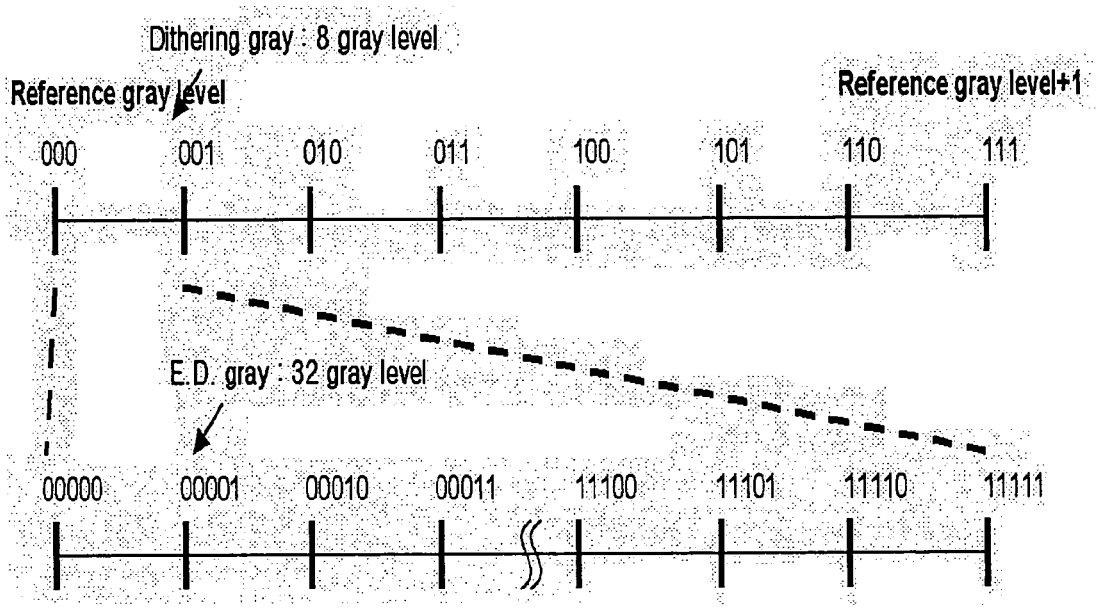
FIG. 16 is a view for explaining that the power of gray level representation is enhanced by the error diffusion and dithering unit shown in FIG. 11.

FIG. 16 is a view for explaining that the power of gray level representation is enhanced by means of the error diffusion and dithering unit shown in FIG. 11.

Furthermore, according to the method and apparatus for processing the video data in the PDP in accordance with another embodiment of the present invention, the number of gray levels, which can be represented, can be further increased by subdividing between-the-gray levels, which are subdivided through the error diffusion operation of the random error diffusion unit 70 as shown in FIG. 16. For example, according to the present invention, basic 256 gray levels can be implemented using 8-bit pixel data, which are outputted through the error diffusion operation and the dithering operation. For example, if 8 gray levels are implemented through the dithering operation and 32 gray levels are implemented through the random error diffusion operation as shown in FIG. 16, a total of 216 gray levels can be represented. Resultantly, according to the method and apparatus for processing the video data in the PDP, the power of gray level representation can be improved while minimizing error diffusion and dithering noise.

As described above, according to the present invention, the dither operation and the random error diffusion operation are performed on video data using random coefficient values. Therefore, the present invention is advantageous in that it can further improve the power of gray level representation and can minimize error diffusion noise.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for controlling display of images in a display device, comprising:

(a) receiving a pixel value having an integer part and a fraction part;

(b) performing a random error diffusion operation on the pixel value, said operation including:

adding one or more error diffusion coefficient values derived for one or more corresponding neighboring pixels, a first random coefficient value, and a first predetermined number of bits of the fraction part of the pixel value to form a carry value, and adding the carry value to a second predetermined number of bits of the fraction part of the pixel value to form a sum, the integer part of the pixel value and the sum forming a random error-diffused value having a number of bits less than the pixel value;

(c) performing a random dithering operation on the random error-diffused value using a second random coefficient value to form dithered video data; and (d) generating an image for display based on the dithered video data.

2. The method as claimed in claim 1, wherein the pixel value is generated by performing an inverse gamma-correction operation on an input pixel value, the pixel value generated by said inverse gamma-correction operation having a number of bits greater than the input pixel value.

3. The method as claimed in claim 1, wherein the one or more error diffusion coefficient values are generated by assigning predetermined different weights to error diffusion values of said one or more neighboring pixels adjacent to a pixel corresponding to the pixel value.

4. The method as claimed in claim 1, wherein performing the random dithering operation comprises:

selecting a dither mask pattern corresponding to the random error-diffused value;

performing an XOR operation on the second random coefficient value and a dither value of the selected dither mask pattern; and adding the XORed value to the random error-diffused value to form the dithered video data.

5. The method as claimed in claim 4, wherein one or more dither values of the selected dither mask pattern is/are outputted according to a combination of a vertical sync signal, a horizontal sync signal and a pixel clock signal.

6. The method as claimed in claim 4, wherein the dither mask pattern is set every gray level and every frame.

7. An apparatus for controlling display of images in a display device, comprising:

a random error diffusion unit that performs a random error diffusion operation on a pixel value having an integer part and a fraction part, the random error diffusion unit performing said operation by:

adding one or more error diffusion coefficient values derived for one or more corresponding neighboring pixels, a first random coefficient value, and a first predetermined number of bits of the fraction part of the pixel value to form a carry value, and adding the carry value to a second predetermined number of bits of the fraction part of the pixel value to form a sum, the integer part of the pixel value and the sum forming a random error-diffused value having a number of bits less than the pixel value; and a random dithering unit that performs a random dithering operation on the random error-diffused value using a second random coefficient value to form dithered video data, the display device displaying an image based on the dithered video data.

8. The apparatus as claimed in claim 7, further comprising:

a gamma correction unit that performs an inverse gamma correction operation on an input pixel value to form the pixel value having the integer part and the fraction part.

9. The apparatus as claimed in claim 7, further comprising:

a random generating unit that generates the first and second random coefficient values provided to the random error diffusion unit and the random dithering unit respectively.

10. The apparatus as claimed in claim 7, wherein the one or more error diffusion coefficient values are generated by assigning predetermined different weights to error diffusion values of said one or more neighboring pixels adjacent to a pixel corresponding to the pixel value.

11. The apparatus as claimed in claim 7, wherein the random dithering unit comprises:

a dither mask table that selects a dither mask pattern corresponding to the random error-diffused value;

an XOR gate that performs an XOR operation on the second random coefficient value and a dither value of the selected dither mask pattern, and an adder that adds the XORed value to the random error-diffused value to form the dithered video data.

12. The apparatus as claimed in claim 11, wherein the dither value of the selected dither mask pattern is outputted according to a combination of a vertical sync signal, a horizontal sync signal and a pixel clock signal.

13. The apparatus as claimed in claim 11, wherein the dither mask pattern is set every gray level and every frame.

14. A method for controlling display of images in a display device, comprising:

(a) receiving a pixel value having an integer part and a fraction part;

(b) performing a random error diffusion operation on the pixel value, said operation including:

adding a random error diffusion coefficient value to one or more calculated error diffusion coefficient values derived for one or more corresponding neighboring pixels and a first predetermined number of bits of the fraction part of the pixel value to form a carry value, and adding the carry value to a second predetermined number of bits of the fraction part of the pixel value to form a sum, the integer part of the pixel value and the sum forming a random error-diffused value having a number of bits less than the pixel value;

(c) performing a dithering operation on the random error-diffused value based on a plurality of dither mask patterns to form dithered video data, wherein the dither mask patterns are stored in a memory on at least one of a gray level basis or a frame basis; and (d) generating an image for display based on the dithered video data.

15. The method as claimed in claim 14, wherein the received pixel value is an inverse gamma corrected pixel value.

16. The method as claimed in claim 14, wherein the calculated error diffusion coefficients values are calculated by assigning different weights to pixels values of the one or more neighboring pixels.

17. The method as claimed in claim 14, wherein adding the random error diffusion coefficient value includes:

replacing one of the calculated error diffusion coefficient values with the random error diffusion coefficient value, and adding the random error diffusion coefficient value with one or more remaining ones of the calculated error diffusion coefficient values and said first predetermined number of bits of the fraction part of the pixel value.

18. The method as claimed in claim 14, wherein performing the dithering operation comprises:

selecting a dither mask pattern among the plurality of the dither mask patterns based on a gray level indicated by a first number of predetermined number of bits of the random error-diffused value;

selecting a dither value at a position corresponding to the random error-diffused value; and adding the selected dither value to a second number of predetermined bits of the random error-diffused value.

19. The method as claimed in claim 18, wherein selecting the dither value comprises:

counting a vertical sync signal, a horizontal sync signal and a pixel clock signal received from an external source, and selecting a position corresponding to the random error-diffused value using the counted signals.

20. The method as claimed in claim 19, wherein selecting the dither value comprises:

selecting dither mask patterns of a corresponding gray level, while toggling the dither mask patterns using the counted signal of the vertical sync signal.

21. The method as claimed in claim 14, wherein dither mask patterns corresponding to a same gray level and frame among the plurality of the dither mask patterns are different for red, green and blue pixels.

22. The method as claimed in claim 14, wherein bits among the video data used for the step of performing the random error diffusion operation are lower bits of bits used for the step of performing the dithering operation.

23. An apparatus for controlling display of images on a display device, comprising:

a random error diffusion unit that performs a random error diffusion operation on a pixel value having an integer part and a fraction part, the random error diffusion unit performing said operation by:

adding a random error diffusion coefficient value to one or more calculated error diffusion coefficient values derived for one or more corresponding neighboring pixels and a first predetermined number of bits of the fraction part of the pixel value to form a carry value, and adding the carry value to a second predetermined number of bits of the fraction part of the pixel value to form a sum, the integer part of the pixel value and the sum forming a random error-diffused value having a number of bits less than the pixel value; and a dithering unit that performs a dithering operation on the random error-diffused value based on a plurality of dither mask patterns to form dithered video data, wherein the dither mask patterns are stored in a memory on at least one of gray level basis or a frame basis, the display device generating an image based on the dithered video data.

24. The apparatus as claimed in claim 23, further comprising an inverse gamma correction unit that performs an inverse gamma correction operation on the inputted video data to form the pixel value having the integer part and the fraction part.

25. The apparatus as claimed in claim 23, wherein the one or more calculated error diffusion coefficient values are calculated by assigning different weights to pixel values of the one or more neighboring pixels.

26. The apparatus as claimed in claim 23, wherein the random error diffusion unit adds the random error diffusion coefficient value by:

replacing one of the calculated error diffusion coefficient values with the random error diffusion coefficient value, and adding the random error diffusion coefficient value with one or more remaining ones of the calculated error diffusion coefficient values and said first predetermined number of bits of the fraction part of the pixel value.

27. The apparatus as claimed in claim 23, wherein the dithering unit comprises:

a dither mask table that stores a plurality of dither mask patterns and selects a dither mask pattern corresponding to a gray level indicated by a first number of predetermined bits of the random error-diffused video value from among the stored dither mask patterns;

a mask control unit that selects a dither value based on a position that corresponds to the random error-diffused value; and an adder that adds the selected dither value to a second number of predetermined bits of the random error-diffused video data.

28. The apparatus as claimed in claim 27, wherein the mask control unit counts a vertical sync signal, a horizontal sync signal and a pixel clock signal received from an external source, and selects a position corresponding to the random error-diffused value using the counted signal.

29. The apparatus as claimed in claim 28, wherein the mask control unit selects dither mask patterns of a corresponding gray level, while toggling the dither mask patterns, using the counted signal of the vertical sync signal.

30. The apparatus as claimed in claim 23, wherein the dither mask table belongs to a same gray level and a frame and further includes different dither mask patterns for the red, green and blue pixels.

31. The apparatus as claimed in claim 23, wherein bits among the video data used for the random error diffusion unit are lower bits of bits used for the dithering unit.

* * * * *